US005177924A

United States Patent [19]

Kakuk

[11] Patent Number: 5,177,924

[45] Date of Patent: Jan. 12, 1993

[54] LIGHTWEIGHT BUILDING COMPONENT

[76] Inventor: Stefan Kakuk, Brunnenstrasse 5, 6839 Oberhausen, Fed. Rep. of Germany

[21] Appl. No.: 869,836

[22] Filed: Apr. 16, 1992

Related U.S. Application Data

[63] Continuation-in-part of Ser. No. 752,998, Sep. 3, 1991, abandoned, which is a continuation of Ser. No. 497,025, Mar. 22, 1990, abandoned, which is a continuation-in-part of Ser. No. 320,820, Mar. 9, 1989, abandoned, which is a continuation of Ser. No. 128,200, Dec. 3, 1987, abandoned.

[30] Foreign Application Priority Data

May 12, 1987 [DE] Fed. Rep. of Germany ..... 8706757
Dec. 3, 1987 [DE] Fed. Rep. of Germany ..... 8632320
Jan. 11, 1990 [DE] Fed. Rep. of Germany ..... 9000238

[51] Int. Cl.[5] ..... E04C 5/00

[52] U.S. Cl. ..... 52/606; 52/659; 52/DIG. 9

[58] Field of Search ..... 52/659, 606, DIG. 9, 52/323, 322, 321, 100

[56] References Cited

U.S. PATENT DOCUMENTS

| | | | |
|---|---|---|---|
| 1,347,146 | 7/1920 | Davis . | |
| 1,414,246 | 4/1922 | Ager | 52/100 |
| 1,604,097 | 10/1926 | Hewlett . | |
| 1,921,518 | 8/1933 | Frobisher . | |
| 1,969,402 | 8/1934 | Heath | 52/100 |
| 2,087,522 | 7/1937 | Meier | 52/100 |
| 2,888,819 | 6/1959 | Sitton . | |
| 3,418,402 | 12/1968 | Grissom et al. . | |
| 3,545,155 | 12/1970 | Church, Jr. . | |
| 3,562,979 | 2/1971 | Ali-Oglu . | |
| 3,660,214 | 5/1972 | Nichols | 52/315 |
| 3,664,076 | 5/1972 | McCoy . | |
| 3,740,909 | 6/1973 | Stinnes | 52/315 |
| 3,874,139 | 4/1975 | Landwoski . | |
| 3,922,832 | 12/1975 | Dicker . | |
| 4,085,001 | 4/1978 | Fukuwatari | 106/711 |
| 4,090,884 | 5/1978 | Goeman | 106/99 |
| 4,123,889 | 11/1978 | Deloupy | 52/100 |
| 4,154,030 | 5/1979 | Huguet . | |
| 4,229,222 | 10/1980 | Schneider | 106/632 |
| 4,301,198 | 11/1981 | Prior . | |
| 4,307,552 | 12/1981 | Votte . | |
| 4,364,979 | 12/1982 | Dutton . | |
| 4,378,401 | 3/1983 | Wright | 52/309.16 |
| 4,398,378 | 8/1983 | Heitzman . | |
| 4,433,521 | 2/1984 | Dietrich . | |
| 4,682,458 | 7/1987 | Sparrow . | |
| 4,690,874 | 9/1987 | Sauer et al. . | |
| 4,748,777 | 6/1988 | Glassco | 52/92 |
| 4,947,611 | 8/1990 | Otsuka | 52/590 |

FOREIGN PATENT DOCUMENTS

| | | |
|---|---|---|
| 250137 | 3/1964 | Australia . |
| 0269990 | 11/1987 | European Pat. Off. . |
| 8536156 | 2/1964 | Fed. Rep. of Germany . |
| 2081257 | 3/1970 | France . |
| 896408 | 5/1962 | United Kingdom . |
| 2084212 | 4/1982 | United Kingdom . |

*Primary Examiner*—Henry E. Raduazo
*Attorney, Agent, or Firm*—Staas & Halsey

[57] ABSTRACT

A building kit including lightweight, extruded components made of environmentally acceptable, i.e., organic and mineral, materials. The lightweight components are made of: a) untreated chopped straw, grain chaff, rice husks, rock fibers and/or glass fibers, b) binders, namely cement, lime and/or gypsum, and c) mineral additives. The components include air chambers and reinforcing members and are connected using I-beams, adhesives, nails, etc.

18 Claims, 7 Drawing Sheets

LIGHTWEIGHT BUILDING COMPONENT

This application is a continuation-in-part of application Ser. No. 07/752,998, filed Sep. 3, 1991, now abandoned, which is a continuation of application Ser. No. 07/497,025, filed Mar. 22, 1990, now abandoned, which is a continuation-in-part of Ser. No. 07/320,820 filed Mar. 9, 1989, now abandoned, which is a continuation of Ser. No. 07/128,200, filed Dec. 3, 1987, now abandoned.

BACKGROUND OF THE INVENTION

The present invention relates to a kit consisting of lightweight components for building walls, supports, ceilings and other structures.

With increasingly stringent sound, fire and heat insulation requirements, building components in use today must have characteristics higher than those required, and yet must be economically manufactured. Despite large-surface shapes, components also should not constrict architects and planners to specific dimensions, grids or series. That is, the shape and structure of the components should lend themselves to a variety of applications, and offer unlimited possibilities with respect to dimensions and architectural design.

It would also be advantageous if building materials were absolutely incombustible, even having a fire-retarding effect, and, in case of fire, produced no smoke or other impermissible gases.

The building materials must be able to breath, must be waterproof and should be resistent to frost and aging. In addition, the building materials must retain their spatial shape over time, so that deformation, shrinkage or swelling does not occur, even under the most extreme conditions.

Preferably, it should be possible to assemble the components in a dry procedure using screws, nails, brackets or adhesives with simple tools, such as saws, drills, grinding machines, etc., and not requiring hoisting tools or other heavy equipment, and the components should have a finished surface or be end-coated. In addition, the components must satisfy necessary static conditions.

The components and facing elements or shells in use today only satisfy these requirements in part, if at all.

SUMMARY OF THE INVENTION

Objects of the present invention are to provide a building kit consisting of lightweight components made of environmentally acceptable, i.e., organic and mineral materials, are heat and sound insulating and, despite the organic additives, are non-flammable, or even fire-retarding, are resistant to water and frost, actively breathe, retain their spatial shape, do not shrink or swell, may be adjusted to the static and architectural conditions in terms of their shape, and which are so light that they may be easily assembled without the use of hoisting tools and heavy equipment. In addition, the shape of these components, combined with the capacity of easy separation into varying widths, gives them an almost unlimited variety of applications.

These objects are achieved by a building kit of lightweight components, including:

a) untreated chopped straw, grain, chaff, rice husks, rock fibers, and/or glass fibers;

b) binders, namely cement, lime and/or gypsum; and c) mineral additives.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

In general, the lightweight components of the present invention are used to build walls, supports, ceilings and other structures, and are preferably formed by extrusion.

Today's building materials must have economical properties in terms of use.

Therefore, it is advantageous for these building materials to have sound-deadening and thermally insulating properties, while being non-combustible and consisting of environmentally acceptable base material.

In terms of economy, the ease of handling and processing on the construction site cannot go unnoticed. Last but not least, the building components must meet the necessary static demands. Today's building components do not, or only partially, meet these demands.

The object of the invention is to provide an assembly kit consisting of non-combustible and environmentally acceptable building material, which is thermally insulating and can be adjusted in its shape to meet static requirements.

According to the invention, this object is achieved in that the assembly kit consists of lightweight building components such as pretreated straw and a binding agent, that the building component has the shape of a board whose body is provided with air chambers, that the building component has the shape of a board with a circumferential welt on three sides and a groove on one side, that the building component has the shape of a board, an opposite welt and a groove on one side.

Further preferred embodiments are characterized by the fact that the building component has the shape of a board, the inner edge of whose welt has a chamfer, that the building component has the shape of a rectangular tube, that the building component has a U-shape, that the building component is shaped like a hollow trapezoid, that the building component has the shape of an elbow, that the building component is h-shaped.

Another preferred embodiment is characterized by the fact that the building component may be provided with a weather-resistant or decorative material at its front face.

Figure 17:
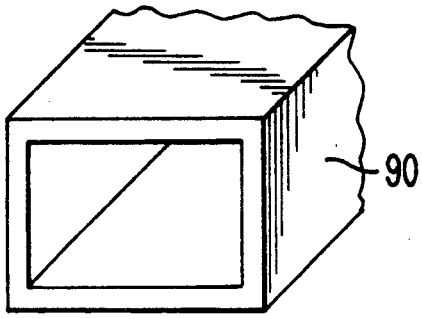
FIG. 17 illustrates a hollow rectangular cross-section profile for the component.

The rectangular profile 90 shown in FIG. 17, may be used vertically as a column or wall boarding for a construction or ventilation duct.

Figure 18:
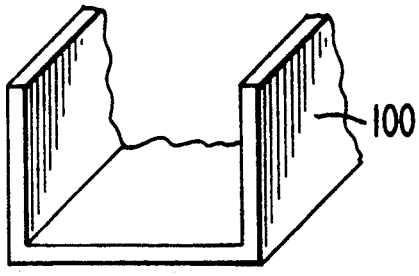
FIG. 18 illustrates a U-shaped cross-section profile for the component.

The U-profile 100 shown in FIG. 18 is well-suited for concrete chutes and ducts, as well as for boardings of installations, but also for installation shafts.

Figure 19:
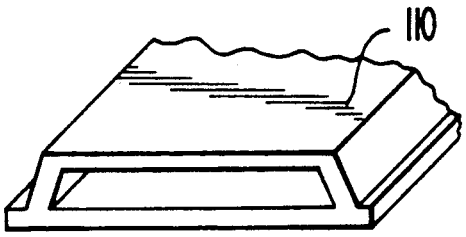
FIG. 19 illustrates a hollow trapezoidal cross-section profile for the component.

FIG. 19 shows one embodiment of the invention in which the building component takes the shape of a hollow trapezoid 110. This profile is used for constructing hollow beam ceilings.

Figure 20:
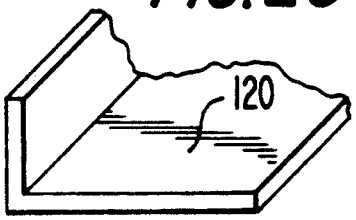
FIG. 20 illustrates an angle cross-section profile for the component.

FIG. 20 shows an angled or elbow profile 120 and is suitable for boarding on installations, boarding of concrete ceilings, or boarding of building components such as roof beams.

Figure 21:
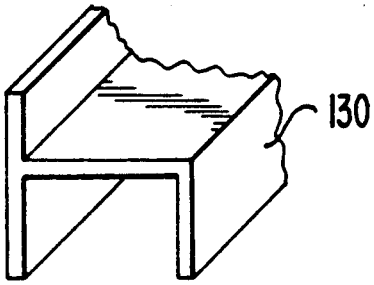
FIG. 21 illustrates an h-shaped cross-section profile for the component.

FIG. 21 depicts an h-profile 130 suitable for use as revolving shutter casing with ceilings.

All the aforementioned profile examples have excellent thermal insulating and sound-deadening properties and can be shaped according to their structural demands.

It goes without saying that all of the building components have the possibility of being provided on the corresponding fronts with materials that can cope with weather conditions or have an attractive appearance.

This invention provides an ideal assembly kit with economical properties that do not require additional thermal insulating and sound-deadening features or, if required, changes in esthetic appearance.

In addition, the invention relates to a lightweight assembly kit which consists of pretreated straw and a binding agent.

The board as taught by the invention may be built as a sandwich board, a strip or a sound-deadening board.

In accordance with today's requirements, building materials should preferably consist of biological raw materials in order to be ecologically acceptable. The building materials should also be flame-retardant, water-repellant, waterproof and possibly non-inflammable.

The building material, and therefore the building boards, should be easily processable, preferably using dry procedures and simple hand tools. The building material should also be terminally coated or the surface should allow for or have further coating such as by means of plywood, veneer, foil, cardboard or paint.

The building materials known heretofore do not, or only partially, meet these demands.

Therefore, the object of the invention is to provide a building material, i.e., a lightweight building board, which meets these demands and possesses all of the properties described above.

This object is achieved according to the invention by providing a lightweight building board consisting of pretreated straw and a binding agent.

This lightweight building board embodying the invention can be used for erecting building components, sandwich boards and strips as well as sound-deadening boards.

The novel lightweight building board is especially humidity-resistant. Its surface has a final finish or is at least suitable for finish treatment such as covering with wallpaper or paint.

The lightweight building board according to the invention is at the same time hard and can be worked with hand tools such as saws and drills.

Due to its straw content, the lightweight building board has excellent heat-insulating and sound-deadening properties as well as superior tensile strength.

The lightweight building board of the invention, because of its straw content, is a so-called biological building material and possesses excellent heating properties.

Because the raw material is straw, which is found in relatively large quantities and accumulates as a waste product, the lightweight building board has a great economic advantage as compared to the building materials known heretofore.

In addition, the lightweight building board has great environmental acceptability.

The straw is pretreated with means that are known from the prior art and which provide the required properties such as flame retardation, water inhibition, etc. These means are known to professionals active in cellulose-containing products.

The joining of the pretreated straw or straw elements to the spatial form of the lightweight building board is carried out by means of per-se known adhesives or binding agents suitable for this purpose in accordance with processes known from the prior art and possibly under application of heat and pressure.

The final coating of the lightweight building board is carried out with per-se known coating agents made of wood or plastics.

Figure 22:
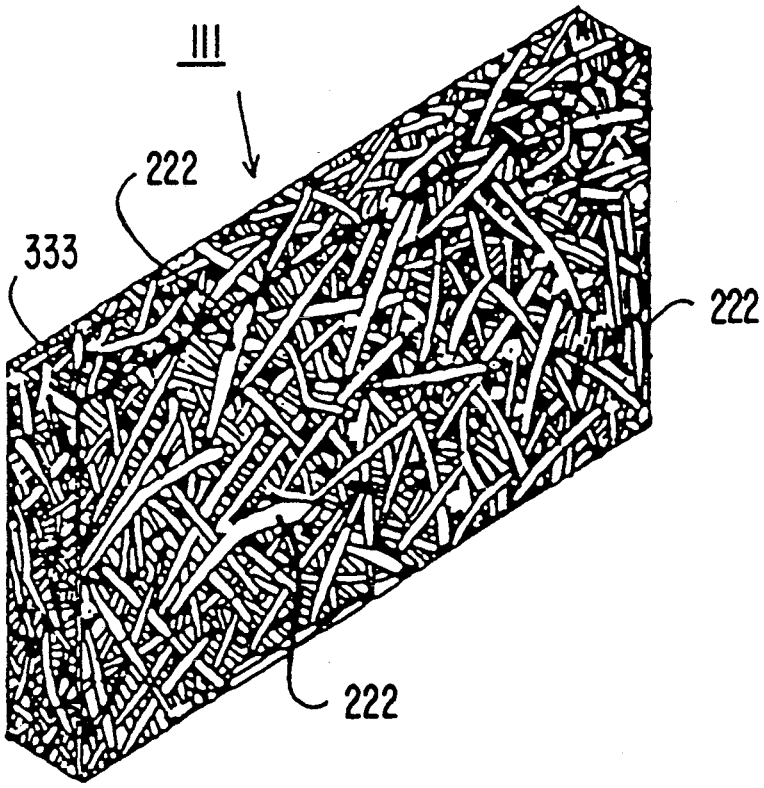
FIG. 22 is a perspective view of the component according to the present invention.

The subject of the present invention is shown in the accompanying FIG. 22.

The reference numeral 111 denotes the subject of the invention, i.e., the lightweight building board in the form of a rectangular board.

The reference numeral 222 denotes the longitudinally split straw elements which are held together by the binding agent 333 which consolidates in the interstices between the straw elements.

Very light mineral substances, such as perlites, pumice, expanded clay, fine sand and mineral dust, and organic substances such as untreated and chopped straw, grain, chaff, rice husks is even peanut shells, are used as additives or fillers. For the purposes of reinforcement, rock or glass fibers may be used, as well as straw.

To facilitate extrusion, conventional lubricants are used, as are retardants. The lightweight components are pressed in a pore-tight manner by means of extruders and have very closely packed through air chambers and a relatively thin cross section. The components can have a relatively large surface area and can act as walls or facing shells for walls.

In one embodiment, the lightweight components include:

a) 20 to 30% of untreated and chopped straw, chaff and/or rice husks;

b) 10 to 15% of fine sand and/or mineral dust;

c) 20 to 25% of cement, lime, mortar and/or gypsum binder;

d) 40 to 50% of perlites, pumice powder and/or expanded clay filler;

e) 10 to 15% of water;

f) lubricants for extrusion; and g) retardants for extrusion.

In another embodiment, the components include:

a) 20 to 30% of chopped rock and/or glass fibers;

b) 10 to 15% of fine sand and/or mineral dust;

c) 20 to 25% of cement, lime, mortar and/or gypsum binder;

d) 40 to 50% of perlites, pumice powder and/or expanded clay filler;

e) 5 to 10% of water;

f) lubricants for extrusion; and g) retardants for extrusion.

In still another embodiment, the components include:

a) 10 to 15% of untreated and chopped straw, chaff and/or rice husks;

b) 10 to 15% of chopped rock and/or glasses;

c) 10 to 15% of fine sand and/or mineral dust;

d) 20 to 25% of cement, lime, mortar and/or gypsum binders;

e) 40 to 50% of perlites, pumice powder and/or expanded clay filler;

f) 5 to 10% of water;

g) lubricants for extrusion; and h) retardants for extrusion.

The organic additives should be admixed in quantities which prevent, in the event of a fire or high temperature, the development of smoke or gases which are impermissible according to fire regulations.

In addition, the water absorption should be low and the building material absolutely resistant to water, frost and aging, despite the partial content of organic substances.

The lightweight components may be furnished with air chambers which provide intrinsic reinforcement, enable easy separation of the components along their lengths at "weak points" spaced at certain intervals, and save on weight and material.

Another preferred embodiment is characterized by the fact that the component can be in a U shape interwoven with air chambers, and can be used as a lintel, header, ceiling, wall or support board. This component can be readily separated into two angles at weak points, and assembled with other components or facing shells into the most varied of structures.

Another preferred embodiment is characterized by the fact that a covering for walls of these components is provided, in which a backfill consisting of the building material described above is made out of small rocks or tiles, and the backfill is continuous in terms of thickness or is perforated with air chambers.

The components are preferably joined together by means of adhesive, screws, nails, brackets, or I beam sections used for alignment and attachment prior to bonding and smoothing. Grooves in opposing notches and bevelling on an outside edge of each notch can be provided in order to achieve a flawless bonding of the components. For this reason, the bonding points, which are held by I beam sections, are temporarily separated as far as possible with wedges in order to obtain as wide as possible a joint, so that the adhesive can be continuously pressed in.

After the adhesive has dried, the wedges are removed, and the joints are smoothed in a fine and flush manner. The hollow spaces or the air chambers receiving the I beam sections are not filled. Rather, the I beam section is, if desired, pulled out and reused at another location.

Detailed descriptions of various embodiments are described hereinafter with reference to the figures.

Figure 1:
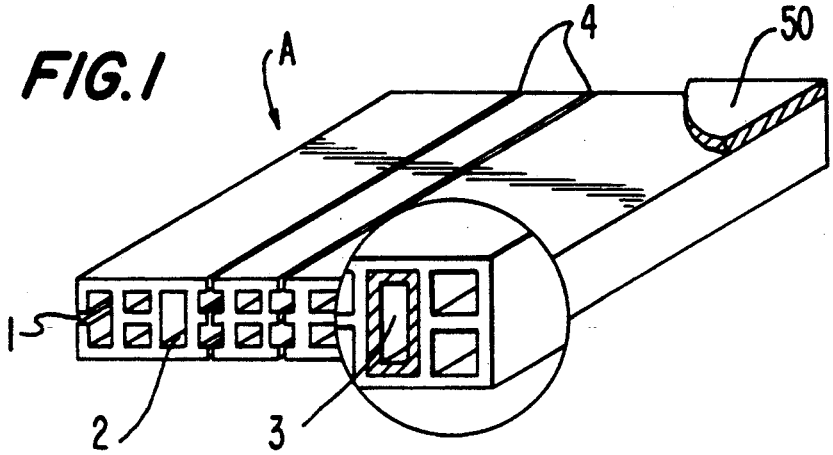
FIG. 1 is a perspective view of a building component according to the present invention, with an exploded view of one side thereof.

FIG. 1 shows a lightweight building component A or facing shell with a connecting slit 1, air chambers 2, a reinforcement member 3 made out of metal or wood, and "weak" or separation points 4. The separation points 4 are placed at certain longitudinal intervals to facilitate separating the components along its length into smaller widths.

Figure 2:
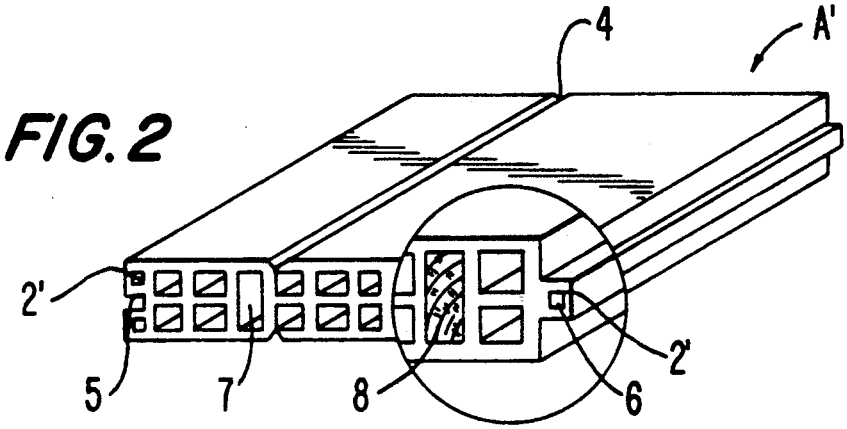
FIG. 2 is a perspective view of a second embodiment of a building component according to the present invention, with an exploded view of one side thereof.

FIG. 2 shows a lightweight component A' or facing shell with a groove 5, a projection 6, air chambers 2' in the groove 5 and the projection 6, an air chamber 7, a reinforcement member 8 made out of wood or metal inserted in the chamber 7, and a separation point 4.

Figure 3:
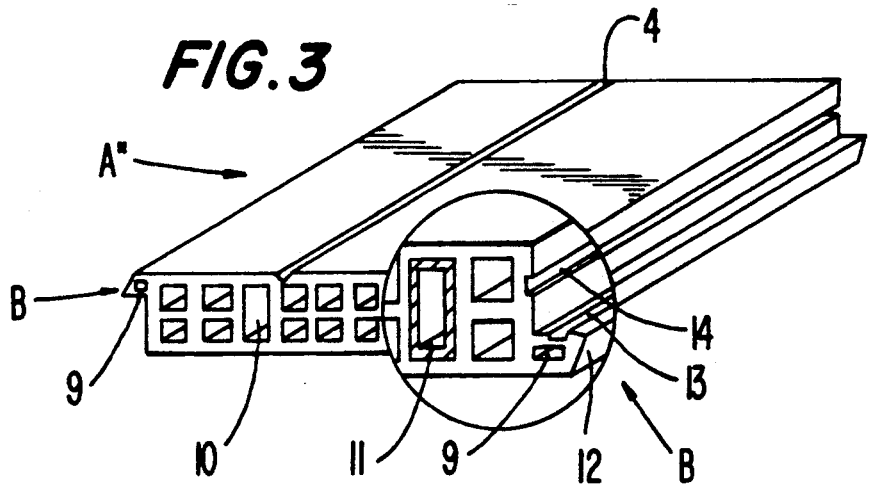
FIG. 3 is a third embodiment of a building component according to the present invention, with an exploded view of one side thereof.

FIG. 3 shows a lightweight component A" or facing shell with diagonally opposed projecting notches B, which are bevelled on an outside edge 12 and include interwoven air chambers 9. The component A" also includes a reinforcement chamber 10, a reinforcement member 11 made out of metal or wood, grooves 13, 14 arranged in each notch B, and a separation point 4.

Thus, the lightweight components A, A' and A" are shaped like a plate with tightly interwoven air chambers, wherein the edges of the components include a slit 1, a groove 5, a projection 6, or notches B, for specially reinforcing the plate, and several air chambers 2 have a metal or wood member, which is inserted in the chambers.

Figure 4:
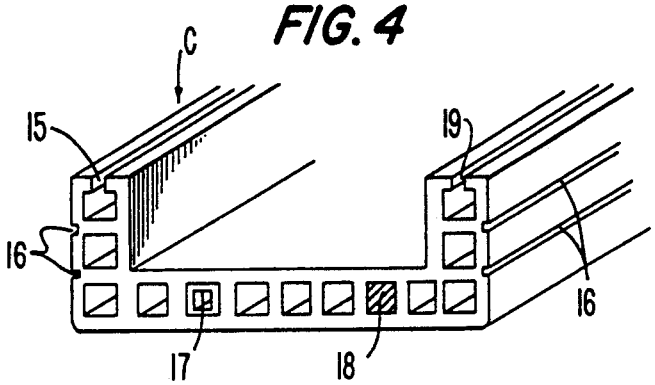
FIG. 4 is a perspective view of a building component according to a fourth embodiment of the present invention.

FIG. 4 shows a U section building component C according to the present invention, which is suitable for use as beams, lintels, supports and wall forms or other revetments. The component C includes connecting slits 15, 19, lateral grooves 16, a metal reinforcement 17 and, optionally, a wood reinforcement 18.

Figure 5:
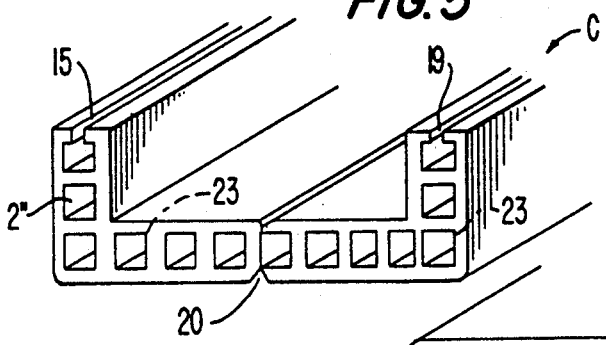
FIG. 5 is a perspective view of a building component according to a fifth embodiment of the present invention.

FIG. 5 shows a U section component C like the one shown in FIG. 4, but also including a central weak or separation point 20.

The U-shaped component or shell C is interwoven with air chambers 2". The external air chambers 2" are continuous with the slits 15, 19 on both legs. The external surfaces of the legs may have grooves 16. Several air chambers have metal members or wood members 17, 18 inserted into the chambers for reinforcement. The middle of the shell has the weak point 20 for easier separation into two angled components 23, if desired.

Figure 6:
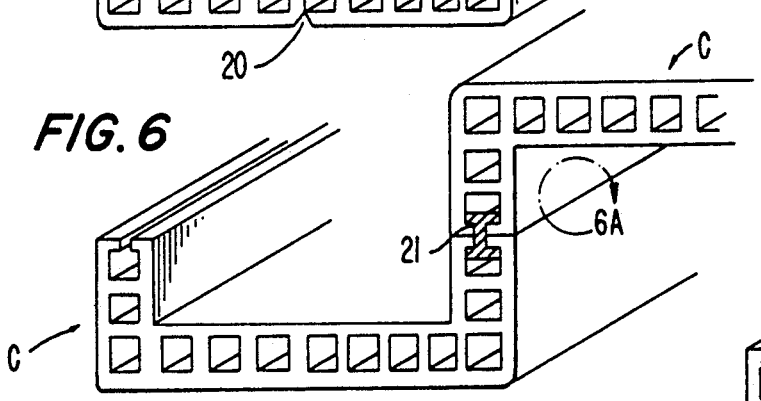
FIG. 6 is a perspective view of building components assembled according to a sixth embodiment of the present
Figure 6A:
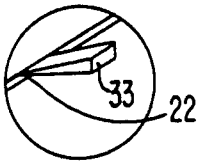
FIG. 6A is a perspective view of a separating wedge used to promote adhesive flow in the component joints.

FIG. 6 shows opposing U section components C held with an I beam section 21, to form a beam or lintel. The enlargement shows a bonding point 22, which is separated with a wedge 33.

Figure 7:
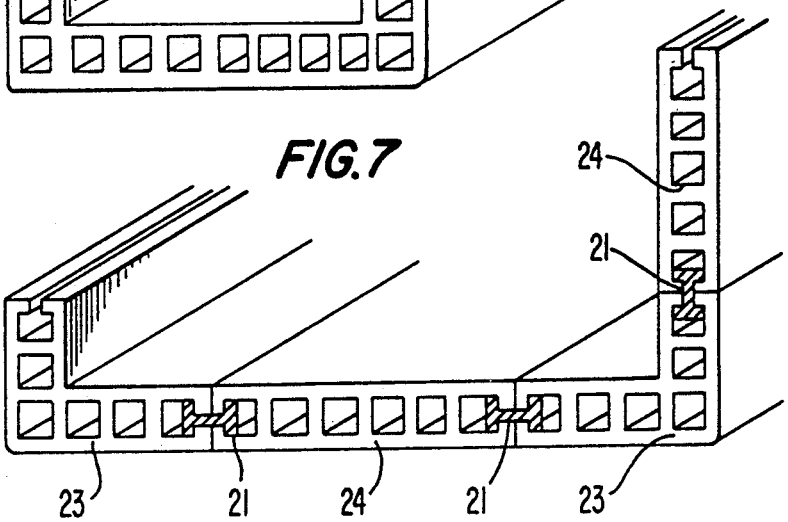
FIG. 7 is a perspective view of building components assembled according to a seventh embodiment of the present invention.

FIG. 7 shows a U shaped section formed by two angle components 23, which are connected by I beam sections 21 with facing shell strips 24. This combination forms a relatively wide and tall lintel or beam.

Figure 8:
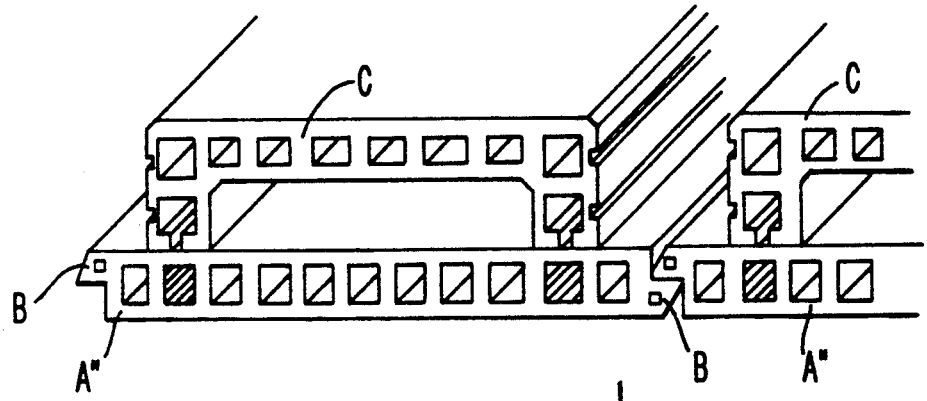
FIG. 8 is a perspective view of building components assembled according to an eighth embodiment of the present invention.

FIG. 8 shows a combination of the lightweight components A" of FIG. 3 connected to the U section components C of FIG. 4, which together form a ceiling component.

Figure 9:
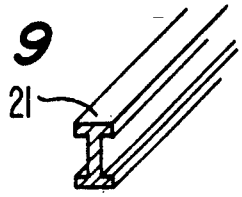
FIG. 9 is a perspective view of a double T section used to assemble the building components of the present invention.

FIG. 9 shows an I beam section 21, which is mounted to the connecting slits 1, 15, 19 to hold the components.

Figure 10:
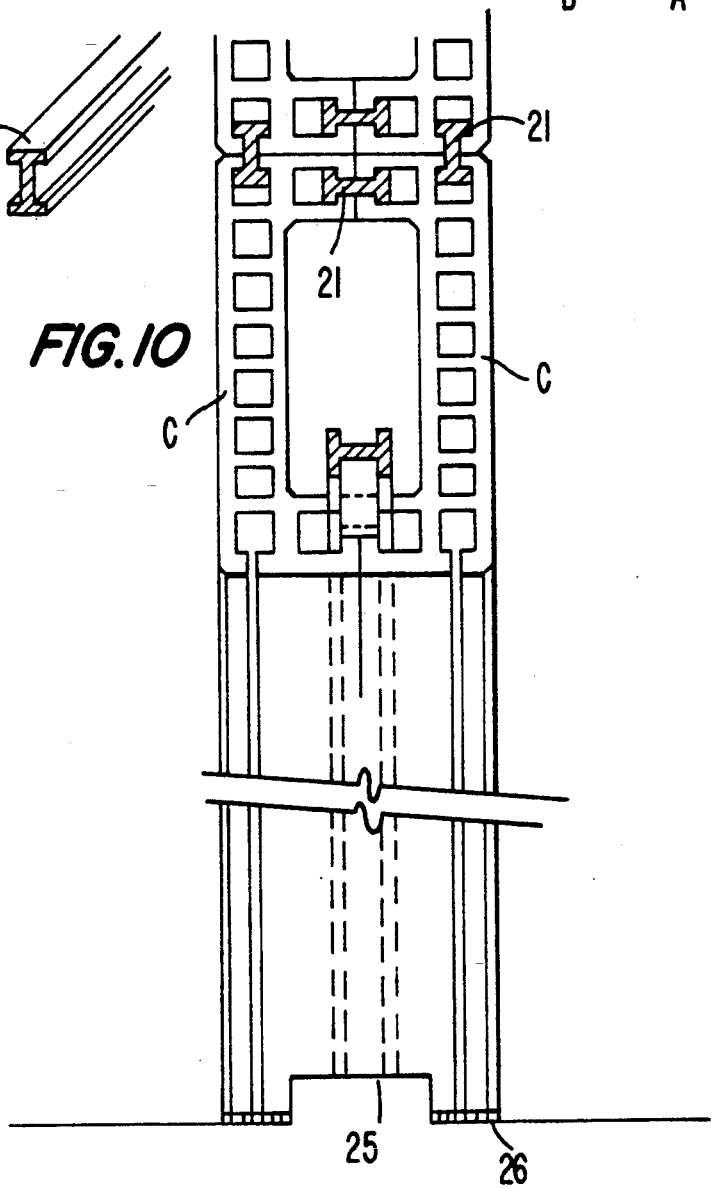
FIG. 10 is a side view of building components assembled according to the present invention.

FIG. 10 shows two joined U shaped lightweight components C shown in FIG. 4, which form a box pipe used as a support, support form, wall part, wall form, shaft or air channel. The supports or wall parts assembled in this way may be used on, e.g., a floor by means of a keyed or grooved base 26 for receiving mortar 25.

Figure 11A:
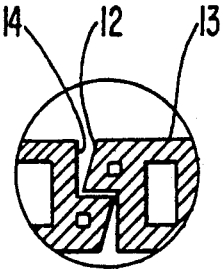
FIG. 11A is a top view of the notch details of FIG. 11.
Figure 11:
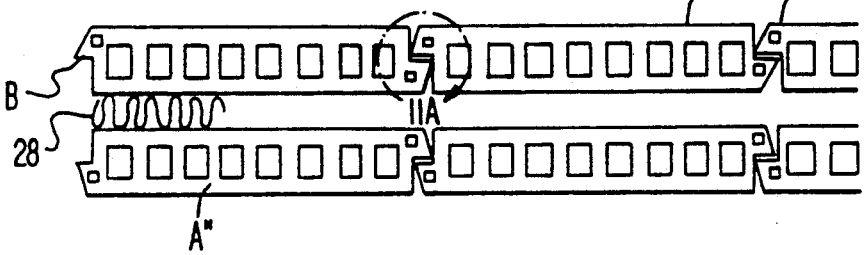
FIG. 11 is a top view of building components assembled according to the present invention.

FIG. 11 shows a hollow wall made out of components A", as shown in FIG. 3, with opposing notches B. The enlargement shows the grooves 13, 14 arranged in the notch B, and the bevelled outside edge 12 of the notch B. Insulation 28 is fit into the hollow.

Figure 12:
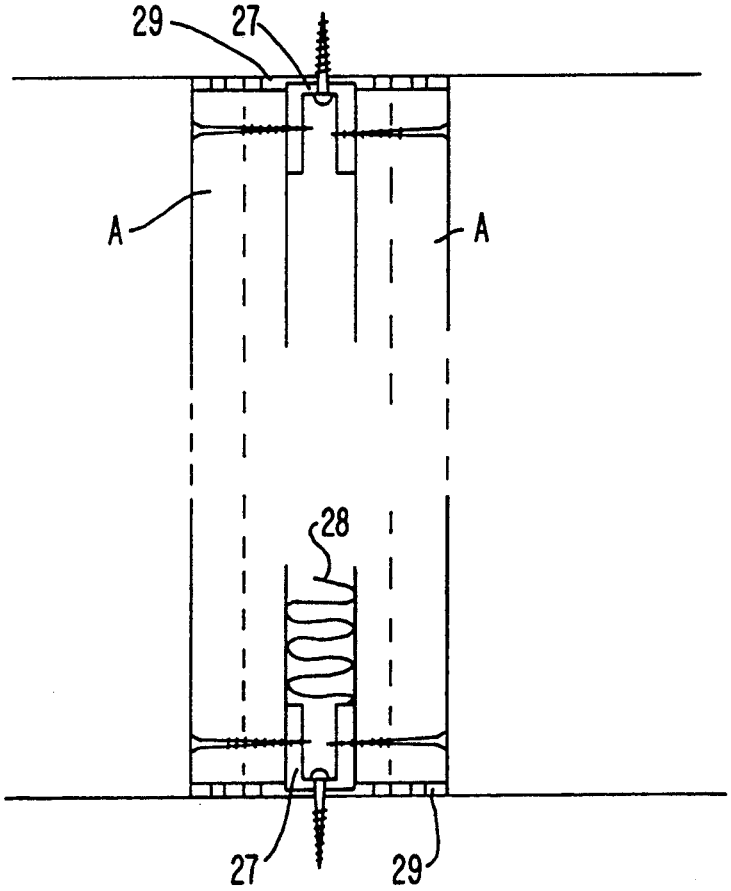
FIG. 12 is a side view of building components assembled according to the present invention.

FIG. 12 shows a hollow wall consisting of two components A and metal brackets 27, which are attached to the floor and to the ceiling, and insulation 28 lying in between the metal brackets 27 for better heat or sound qualities. Connection to the ceiling and floor is established by the formation of a grooved base or joint 29.

Tiles or facing bricks can be imbedded in mortar on the assembled components discussed above, and thereby form large, interlocked surfaces, and the back of the tiles or facing bricks may be perforated.

Figure 13:
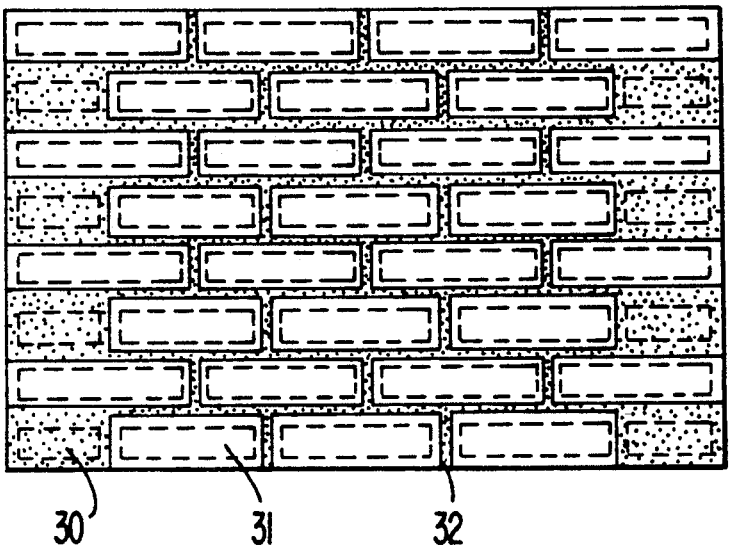
FIG. 13 is a front view of facing brinks to cover the building components assembled according to the present invention.
Figure 14:
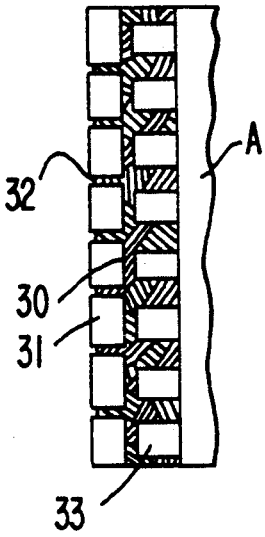
FIG. 14 is a side view of the facing brinks shown in FIG. 13.

More particularly, FIG. 13 and 14 show interlocked members made out of facing bricks 31, behind which is backfill 30 and a hollow chamber 33. Mortar finish joints 32 are also shown.

Figure 15:
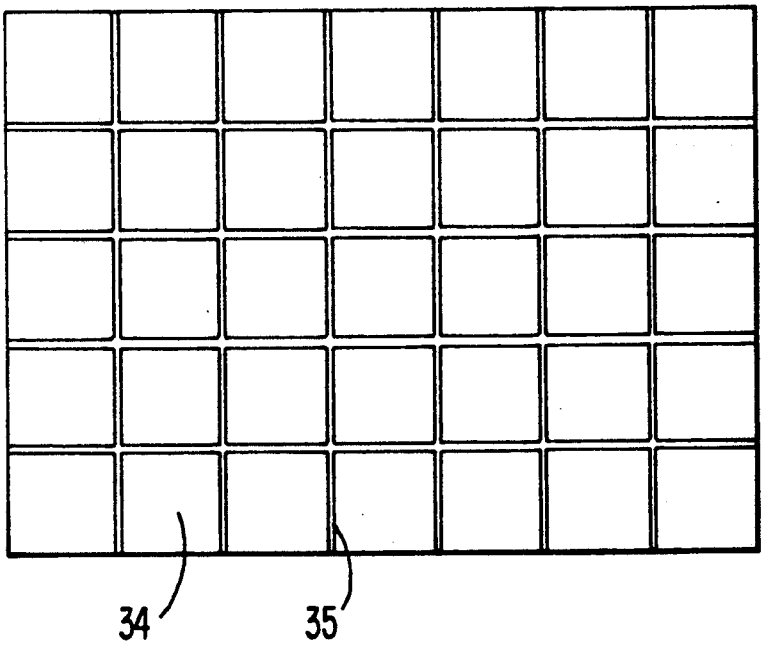
FIG. 15 is a front view of tile to cover the building components assembled according to the present invention.
Figure 16:
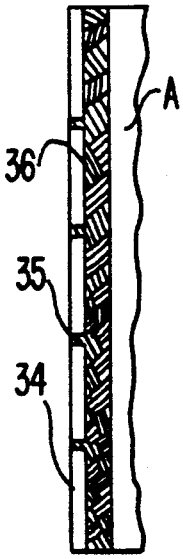
FIG. 16 is a side view of the tiles shown in FIG. 15.

FIGS. 15 and 16 similarly show tiles 34 with finish joints 35 and backfill 36.

The elements shown in FIGS. 13–16 are a cover layer for the building components shown in FIGS. 1–12. They generally serve a decorative function. The cover layer can be attached to the lightweight components during manufacturer or after the lightweight components are assembled at a site.

FIG. 1 also shows a similar cover member 50 for the lightwieght building components according to the present invention. The cover 50 can be, e.g., plywood, veneer, sheeting, cardboard, paint or a weatherproof covering.

All of the embodiment described above have excellent heat and sound insulating properties, and may be altered in terms of shape depending on the static requirements. Of course, all components may be coated or jacketed on the external faces with other materials, such as wallpaper, depending upon weather conditions and visual concepts. Further, the present invention provides lightweight components, e.g., facing shells, which satisfy and will continue to satisfy the most stringent requirements of sound, heat and fire protection in the most economic way.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

I claim:

1. Lightweight elongated extruded structural component for walls, columns and ceilings, comprising longitudinally split straw fragments which are bound by a binding agent, and impregnated with a water repellant agent, wherein the lightweight component is provided with air chambers extending in the longitudinal direction of the component.

2. Lightweight component according to claim 1, wherein the component is in the form a rectangular board, a body of which is provided with the air chambers.

3. Lightweight component according to claim 1, wherein the component is in the form of a rectangular board with a welt on three edges and a groove on the remaining edge.

4. Lightweight component according to claim 1, wherein the component is in the form of a rectangular board with welts on two opposing edges and a groove on another edge.

5. Lightweight component according to claim 1, wherein the component is in the form of a rectangular board having a welt with one edged bevelled.

6. Lightweight component according to claim 1, wherein the component is in the form of a tube having a rectangular cross-section.

7. Lightweight component according to claim 1 wherein the component is U-shaped.

8. Lightweight component according to claim 1 wherein the component is in the form of a hollow trapezoid with a welt on two opposing longitudinal edges.

9. Lightweight component according to claim 1, wherein the component is in the form of an angular cross-section.

10. Lightweight component according to claim 1, wherein the component has an h-shaped cross-section.

11. Lightweight component according to claim 1, further comprising a material coated on at least one surface thereof.

12. Lightweight component according to claim 11, wherein the material is weather proof.

13. Lightweight component according to claim 11, wherein the material is plywood.

14. Lightweight component according to claim 11, wherein the material is veneer.

15. Lightweight component according to claim 11, wherein the material is sheeting.

16. Lightweight component according to claim 11, wherein the material is cardboard.

17. Lightweight component according to claim 11, wherein the material is paint.

18. Lightweight component according to claim 1, wherein the straw fragments are impregnated with a flame retarding material.

* * * * *